US005146855A

United States Patent [19]

Morgan

[11] Patent Number: 5,146,855

[45] Date of Patent: Sep. 15, 1992

[54] ARRANGEMENT FOR THE COMPLEMENTARY INTERCONNECTION OF ROUND TABLE TOPS

[76] Inventor: Brian J. Morgan, 20 Cichon Road, Bridgewater, Australia

[21] Appl. No.: 646,752

[22] PCT Filed: Jun. 27, 1989

[86] PCT No.: PCT/AU89/00274

§ 371 Date: Dec. 31, 1990

§ 102(e) Date: Dec. 31, 1990

[87] PCT Pub. No.: WO90/00022

PCT Pub. Date: Jan. 11, 1990

[30] Foreign Application Priority Data

Jul. 1, 1988 [AU] Australia ..... PI9083

[51] Int. Cl.[5] ..... A47B 57/00

[52] U.S. Cl. ..... 108/64; 108/150; 108/66; 52/66

[58] Field of Search ..... 108/150, 64, 66; 52/575

[56] References Cited

U.S. PATENT DOCUMENTS 2,556,362 6/1951 Crumpler ..... 108/64 X
2,705,179 3/1955 Hodgin ..... 108/64
3,002,787 10/1961 Ziegenfuss ..... 108/64 X

FOREIGN PATENT DOCUMENTS 983986 2/1976 Canada ..... 108/64
1463176 11/1966 France ..... 108/64

*Primary Examiner*—Peter A. Aschenbrenner
*Attorney, Agent, or Firm*—Pearne, Gordon, McCoy & Granger

[57] ABSTRACT

A round top table arrangement in which there are one or more in-fill pieces (7,8) engaging with underneath clamps (14,16) adjacent edges of adjoining round top tables to provide contiguous edges and a preferred shape of supporting surface. The shape of the outer edges (10) of the respective round top tables includes an externally exposed convex surface including, however, abutting shapes providing for interlocking support which can also locate an in-fill piece with respect to both vertical and horizontal alignments and there are clamping means (14,16) including a clamping arm (14) which extends beneath such convex shape and which can be tightened to hold such in-fill pieces (7,8) in substantial interlocking alignment.

10 Claims, 13 Drawing Sheets

ARRANGEMENT FOR THE COMPLEMENTARY INTERCONNECTION OF ROUND TABLE TOPS

Figure 1:
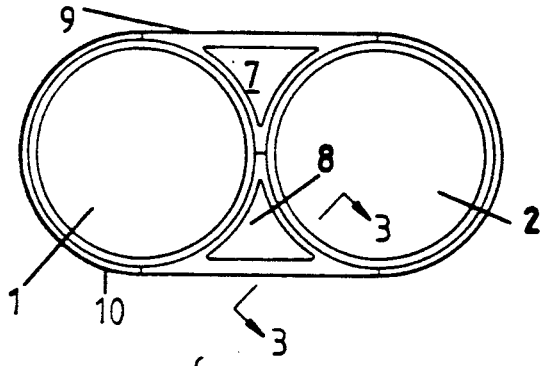

This invention relates to tables and in particular to tables of a type having round tops.

Round tables are very popular in many commercial dining applications but they have some disadvantages which are addressed by the present invention.

The first difficulty is that a round top table is not particularly convenient when being used with other round top tables in adjacent alignment.

According to this invention then there are proposed means to effect an in-fill between adjacent edges when round top tables are located in an adjoining relationship.

A number of problems still exist however with such a proposal, at least in the simplest approach.

One significant application for round top tables used in conjunction with in-fill pieces is in connection with commercial catering where various arrangements of tables will be called for from time to time including either individual round top tables, long tables, u-shaped tables and so on.

A further important aspect is that in relation to any mechanical arrangement of tables, it must be serviceable from a maintenance point of view, have an adequate or good appearance so as to appeal to an operator's clients, and it must not be especially vulnerable to breakage.

In a first aspect of this invention, there are accordingly proposed in-fill pieces to be located and adjoined thereto with respect to adjacent edges of respective round top tables.

In preference, the round top tables have tops which are each of the same diameter and height as each of the other tables so that perhaps self-evidently, the in-fill pieces are connecting between substantially identical tables.

In preference, the in-fill pieces are adapted to follow the circular periphery with respect to adjacent tables and accordingly in one arrangement an in-fill piece has an approximate triangular shape with two sides of the triangular shape having a concave alignment to match with that of the corresponding round top of a table.

In another case, the in-fill piece is substantially two such triangular pieces connected apex to apex with however a significant increase in width so that the opposite sides of the piece have an approximate semi-circular concave shape and each end is squared off.

Once one has the idea of providing an in-fill shape, there are a number of configurations which can be used to appropriately provide such in-fill and hence make the assembly of round top tables most convenient for achieving substantially all other generally useful table top shapes available.

The next problem however relates to the specifics of the table construction.

Broadly the problem is to make any construction sufficiently strong so that it will indeed be useful for all the purposes described while at the same time not getting caught with problems of appearance or in another instance providing apertures which can capture food and therefore become unsanitary.

For instance, one of the problems with using an in-fill piece is to provide means by which it can be secured to an existing round top table in such a way that it will not indeed get caught with these problems.

For instance, if there is proposed that each of the in-fill pieces have a tongue at least extending around their concave edge parts and that there is a matching slot within the edge of each circular table, the slot within each edge of the table becomes vulnerable to capture of dirt and may require constant cleaning and at the same time an outwardly extending tongue of the type being discussed becomes vulnerable to accidental impact and therefore fracture.

According to this invention there has been proposed therefore that around the edge of each of the circular top tables there be as an externally exposed surface, a convex shape when looked at in cross-section and which shape is outwardly facing from the body of the circular top table, an there is a matching complimentary shape along the respective edges of an in-fill piece, and there are clamp means adapted to engage beneath the existing respective round table top whereby to hold such respective surfaces together.

In preference, there is provided a downwardly extending lip which extends around the periphery of each round table top and with each in-fill piece, there is a respective clamp means including a clamp arm which can engage and tighten by engagement against an inner part of the said lip.

By providing such an openly exposed convex shape, this can indeed simply therefore be the shape of the normal roll off or covering shape of existing tables which therefore are not vulnerable to capture of food particles or have any cleansing problems and at the same time can be of quite excellent appearance.

While in one case, the convex shape can extend from its upper edge being tangential and coincident with a flat upper surface just below an upper surface of the table top and then extend around to be substantially vertical when the table is on a horizontal base, it has been found of advantage to provide that the convex surface is inset just slightly into the edge of the table so that there is when proceeding from the table top, a first vertical or substantially vertical step, a then substantially horizontal portion curving around to a substantially vertical portion, and then an outwardly extending step terminating in the outer edge of the bottom of the lip part.

A corresponding edge shape of an in-fill piece can then have an outer surface corresponding to the shape but with such dimensions that an upper edge of this when located in coincident alignment will provide a flush and therefore continuing horizontal planar surface with such an adjoining table top and a bottom edge will abut the outwardly extending step on the respective table top.

Looking now at a clamp piece, there can be provided an outwardly extending clamp arm which is adapted to be raised into a tightening and clamping position or it can be lowered relative to the in-fill piece so as to be opened for engagement.

In preference, the outwardly and upwardly extending arm has an inner surface which is inclined to the vertical and is adapted to engage an inside corner of the downwardly depending lip of the table so that with an upward clamping action, there can be caused a squeezing together of the respective parts and hence a tightening of the clamping action.

The clamp itself will obviously be designed so as not to be protrusive below the in-fill piece so as not to indeed cause difficulty to diners so that there is proposed that the clamping arm be of pressed metal and having midway an aperture therethrough, and an engaging screw head engaging a bolt affixed to the underneath side of the in-fill piece such that with tightening of the screw head, this will cause a relative raising of the outside part of the clamp arm and hence a clamping effect.

Figure 2:
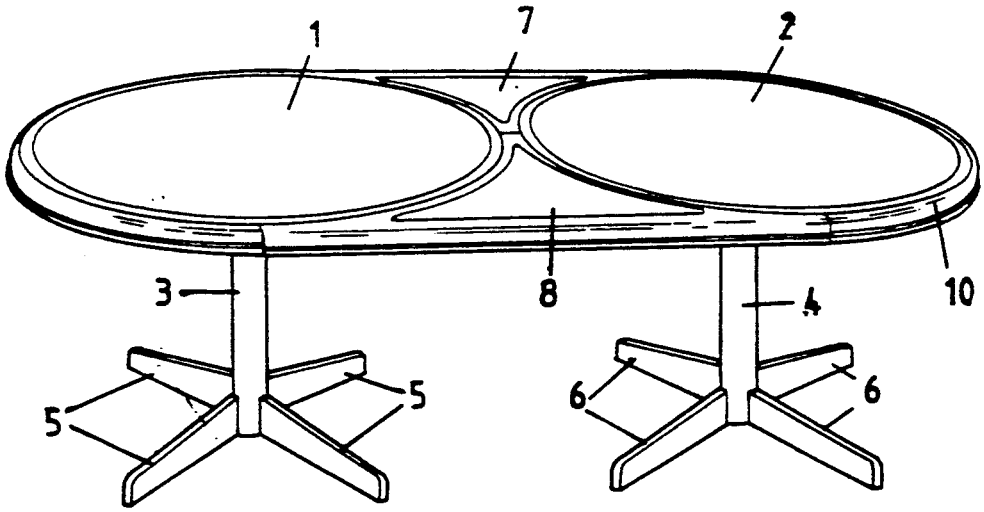
Figure 3:
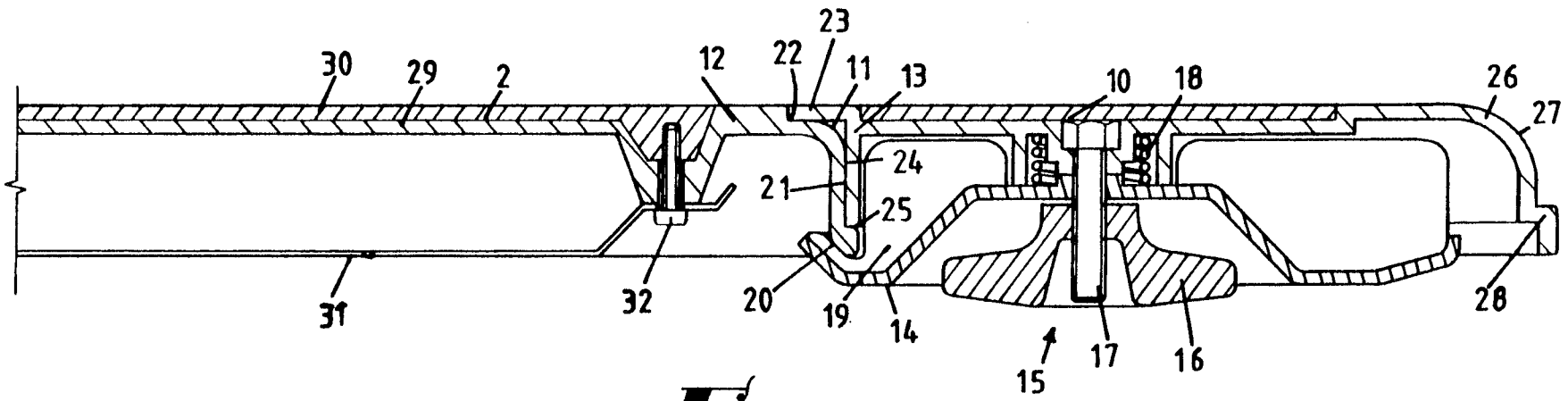
Figure 4:
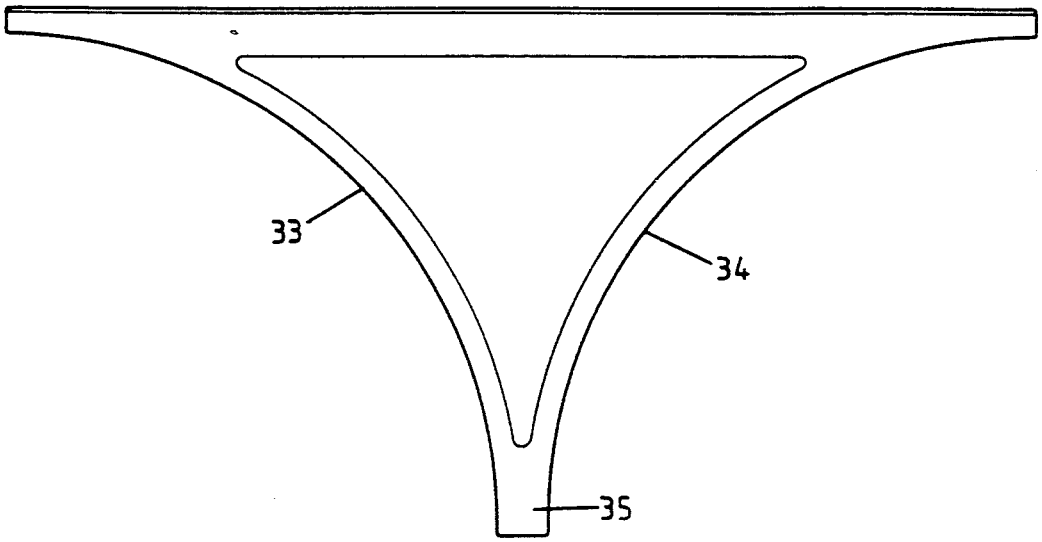
Figure 5:
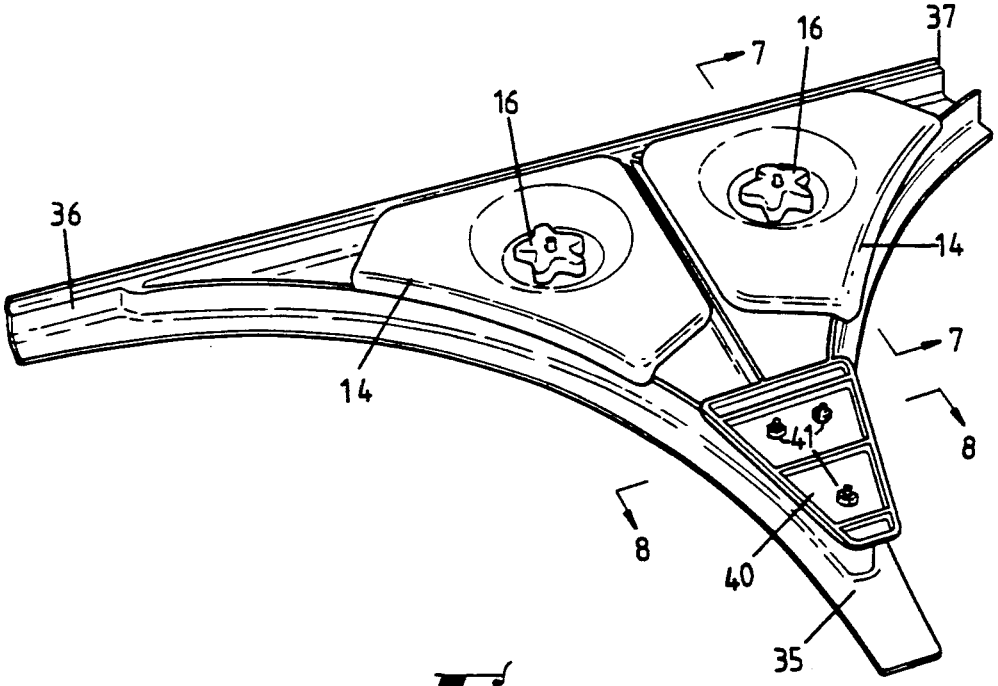
Figure 6:
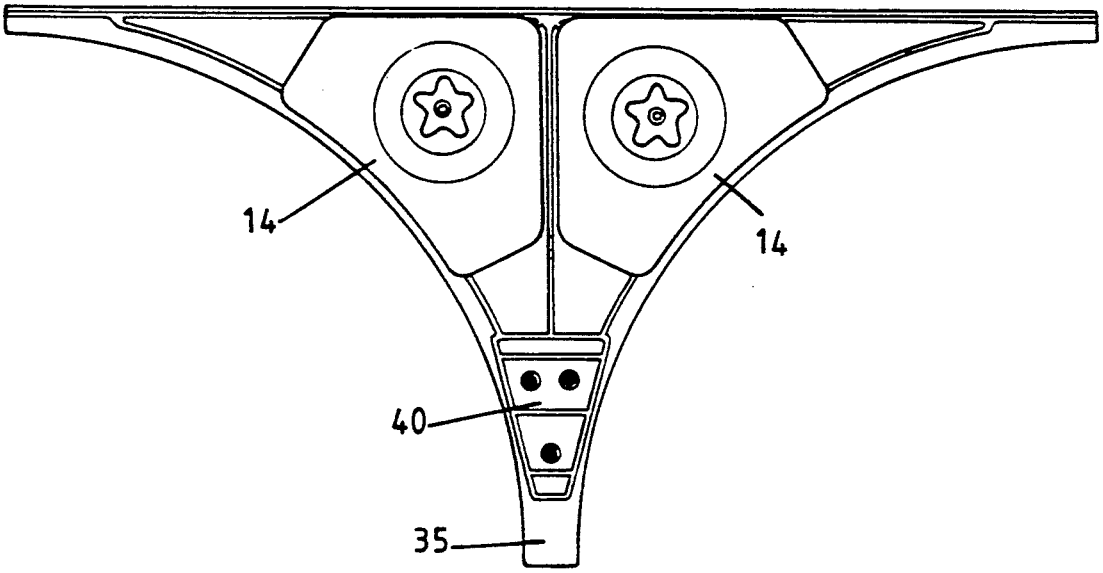
Figure 7:
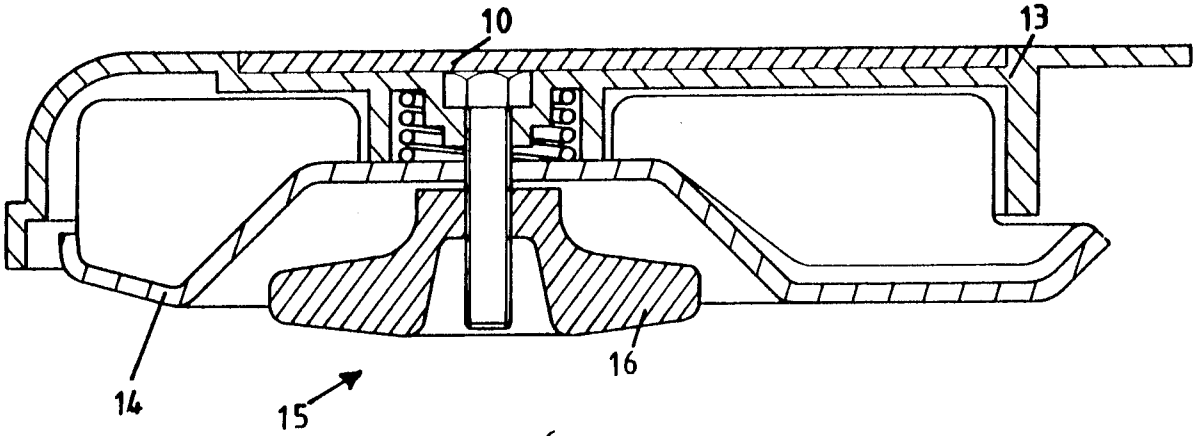
Figure 8:
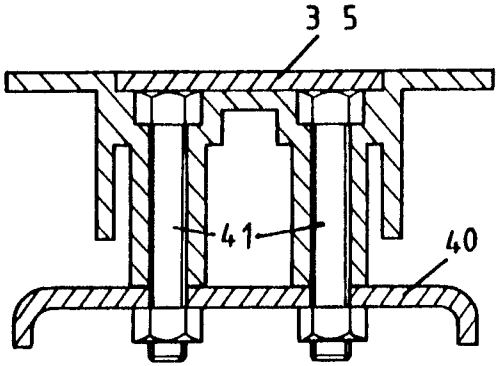
Figure 9:
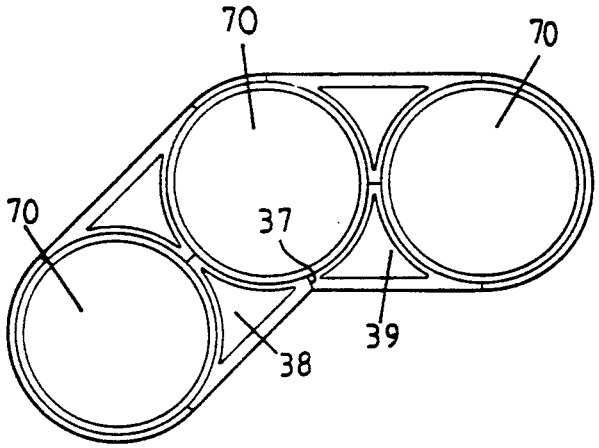
Figure 10:
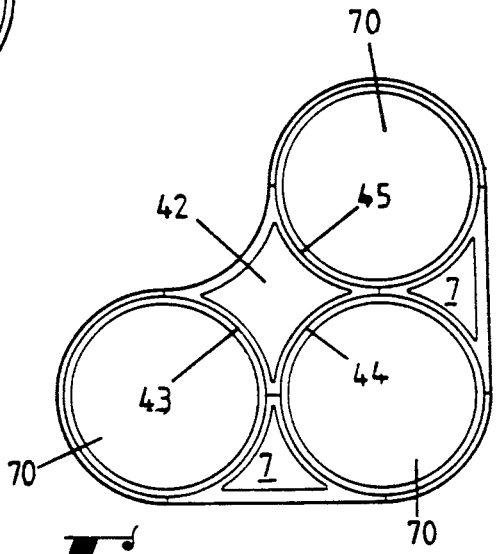
Figure 11:
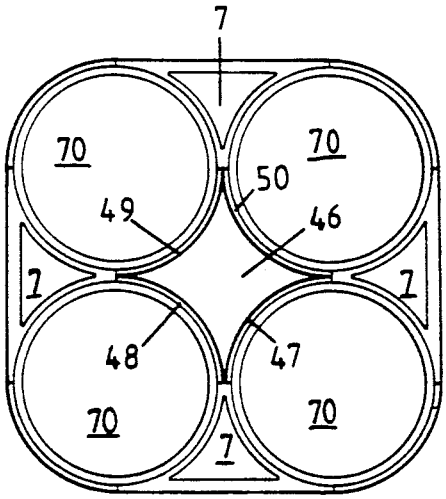
Figure 12:
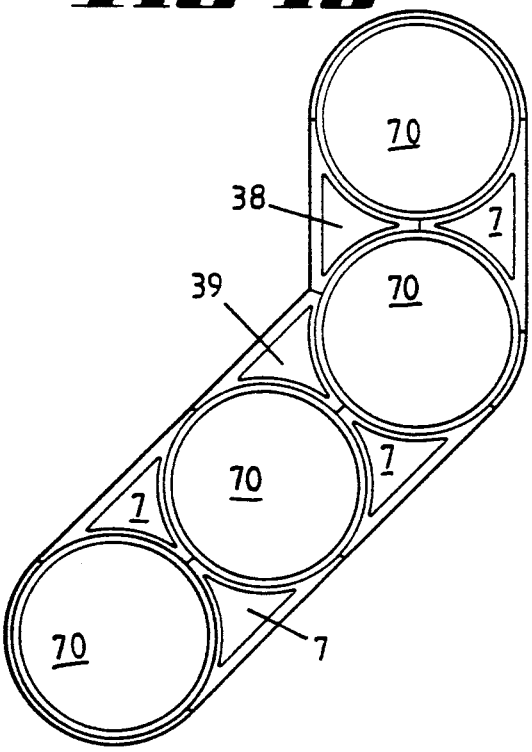
Figure 13:
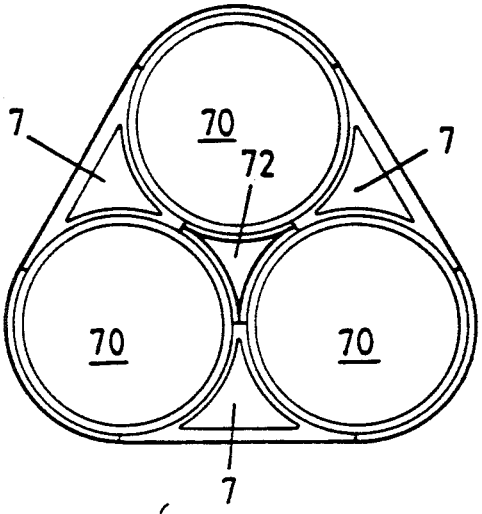
Figure 14:
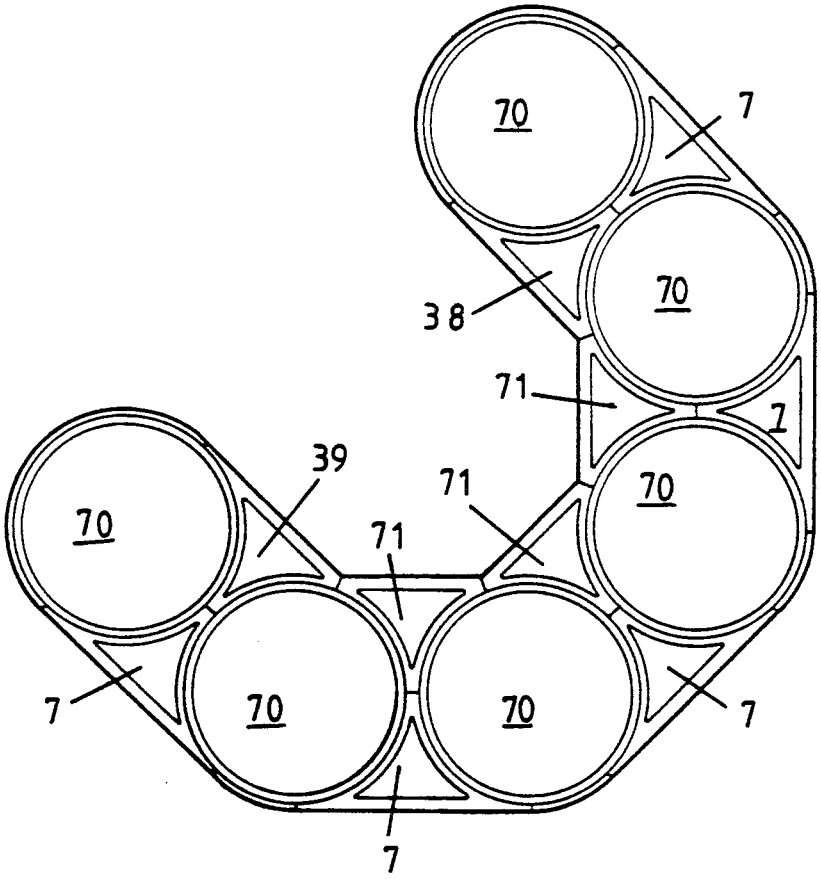
Figure 15:
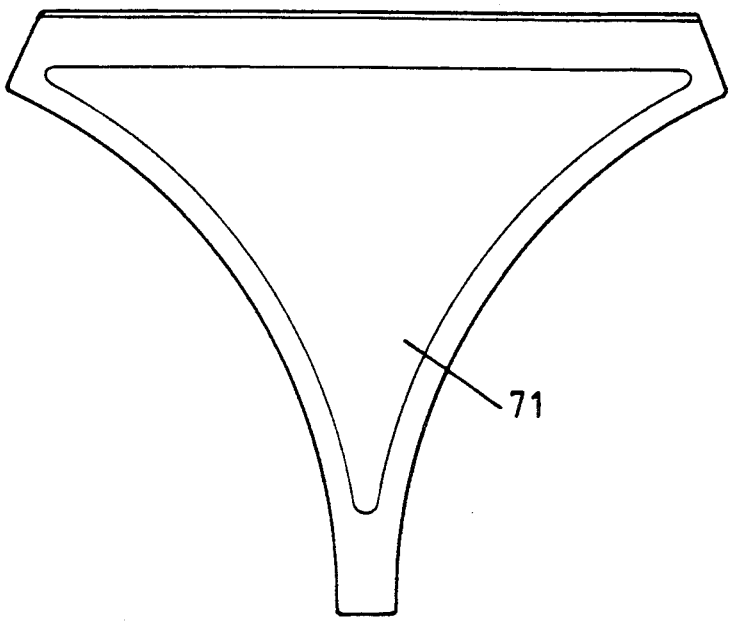
Figure 16:
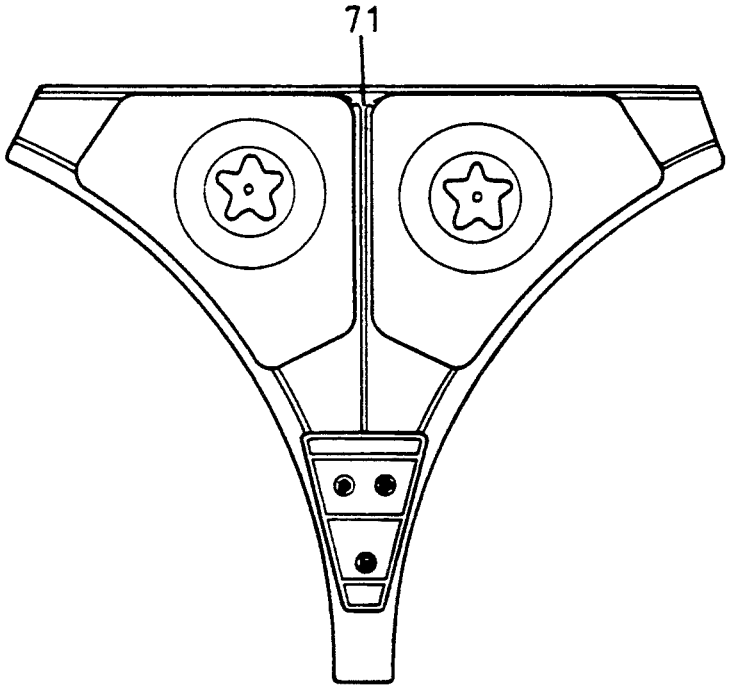
Figure 17:
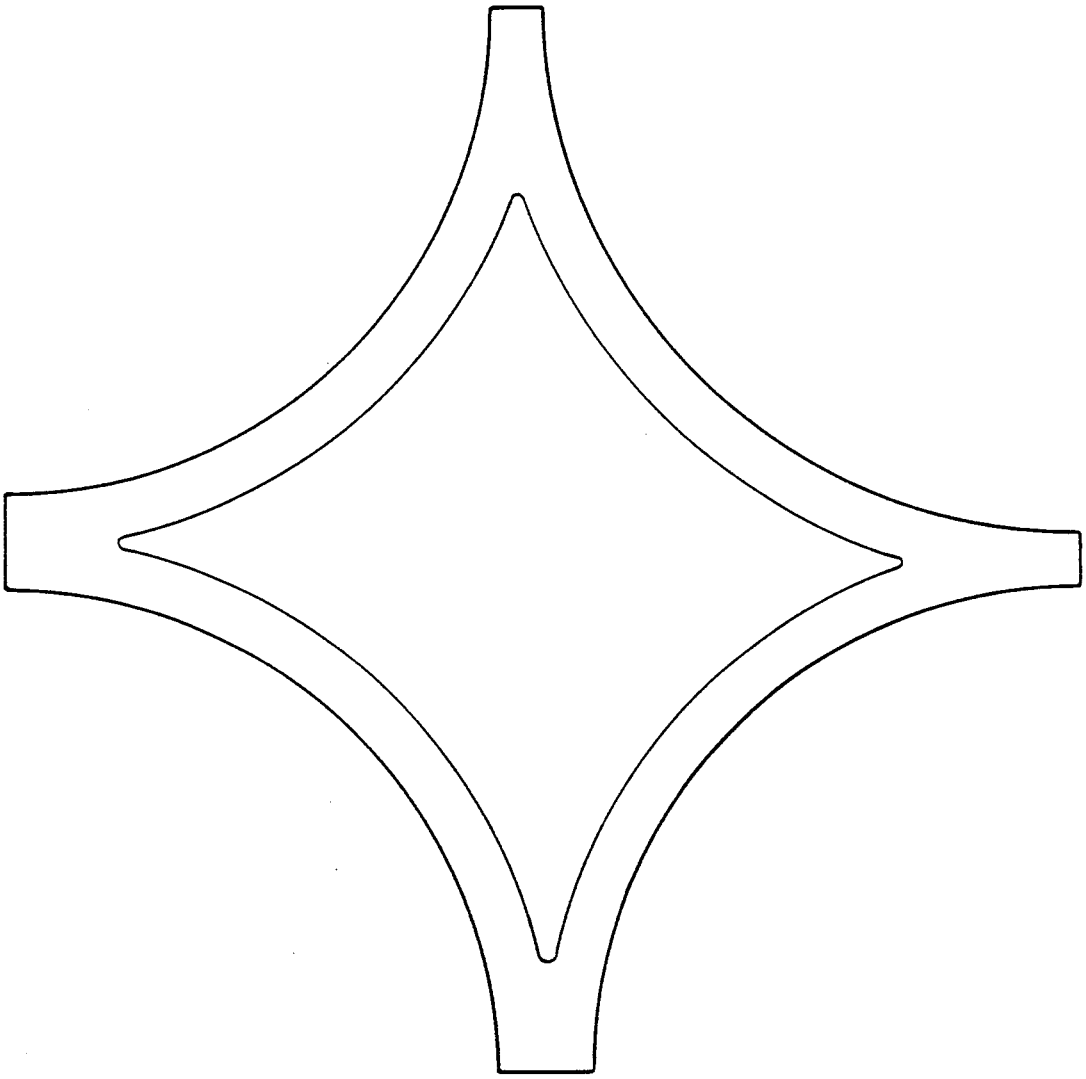
Figure 18:
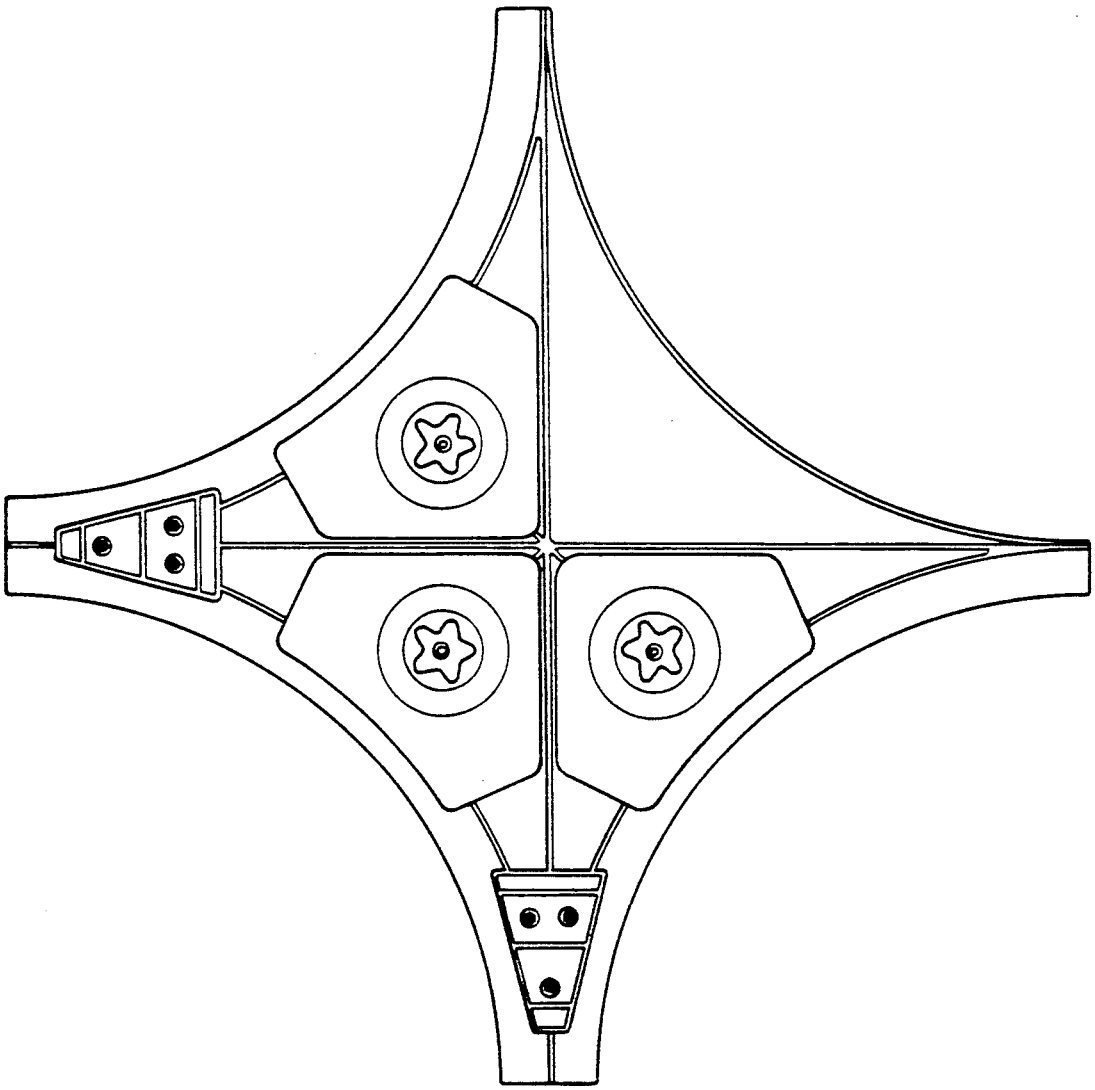
Figure 19:
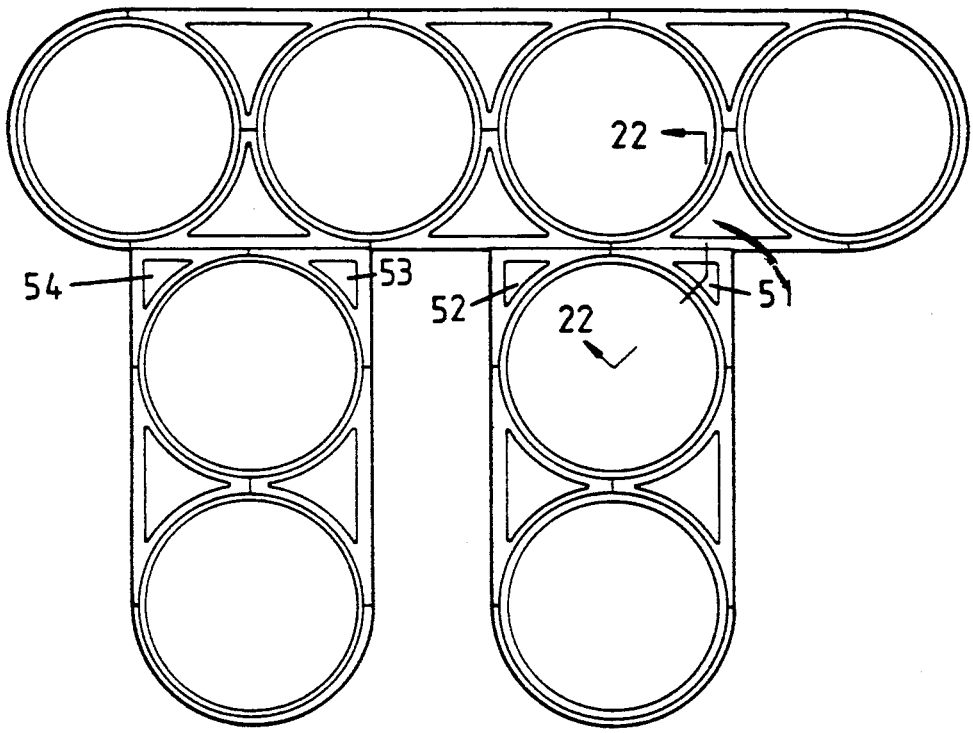
Figure 20:
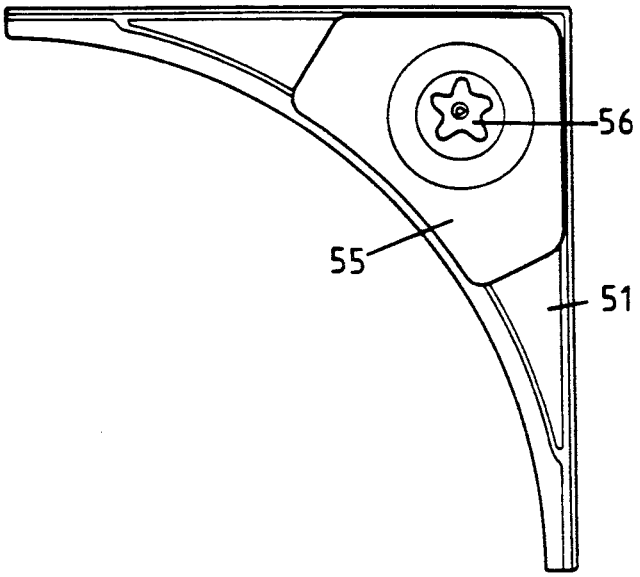
Figure 21:
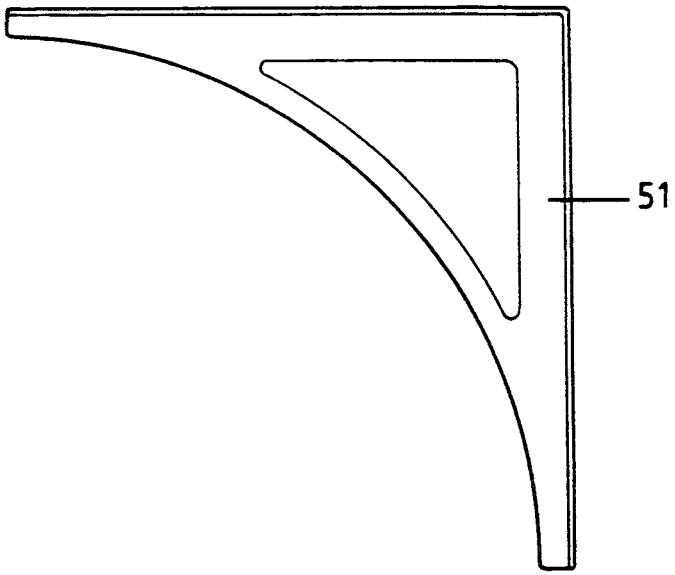
Figure 22:
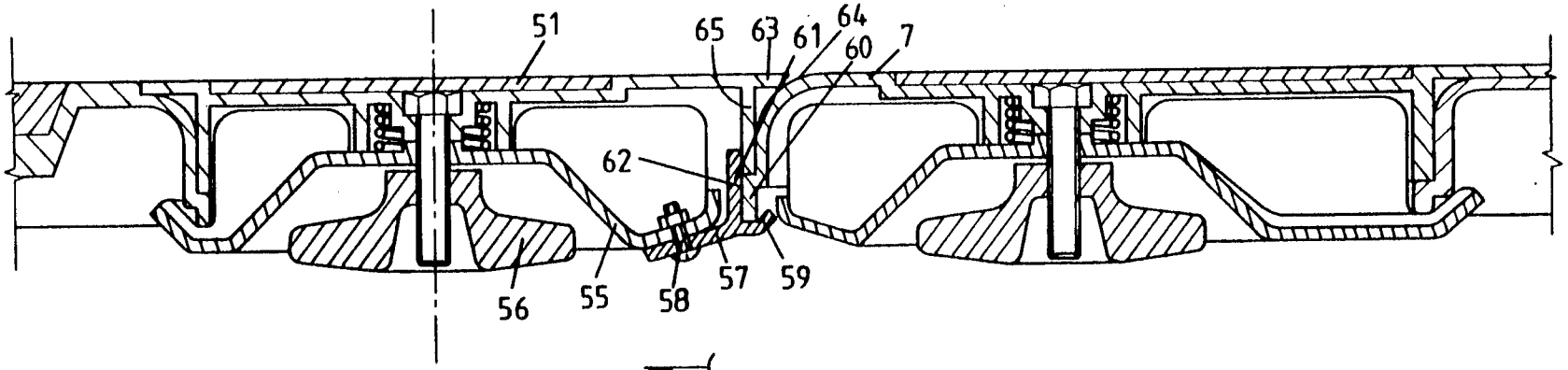

For a better understanding of this invention will now be discussed with the assistance of drawings in which FIG. 1 is a plan view of an assembly according to a first embodiment of this invention, FIG. 2 is a perspective of the arrangement of the first embodiment as shown in FIG. 1, FIG. 3 is a cross-sectional view along the lines 3—3 as shown in FIG. 1, FIG. 4 is a top view of the in-fill piece two of which are used in respect of the round tables shown in the first embodiment in FIGS. 1, 2 and 3, FIG. 5 is an underneath perspective view of the in-fill piece as shown in FIG. 4, FIG. 6 is a plan view of the in-fill piece as shown in FIG. 5, FIG. 7 is a cross-sectional view through the in-fill piece as shown in FIG. 5 along the lines 7—7, FIG. 8 is a cross-sectional view of the in-fill piece as shown in FIG. 5 along the lines 8—8, FIG. 9 is a plan view of an assembly of three round tables connected by triangular pieces in accordance with a second embodiment of the invention, FIG. 10 is an assembly of three round tables connected together with respect to a third embodiment of the invention, FIG. 11 is a plan view of an assembly of four tables in accord with a fourth embodiment of the invention, FIG. 12 is a plan view of an assembly of four tables in accord with a fifth embodiment of the invention, FIG. 13 is an assembly of three tables in accord with a sixth embodiment of the invention, FIG. 14 is a plan view of six round tables connected together according to a seventh embodiment of the invention, FIG. 15 is a plan view of an in-fill piece similar to the in-fill piece shown in FIG. 4 but with augmented corners as particularly used in the seventh embodiment shown in FIG. 14, FIG. 16 is an underneath view of the in-fill piece as shown in FIG. 15, FIG. 17 is a plan view of an in-fill piece as shown in both the third and fourth embodiment as shown in FIGS. 10 and 11 and, FIG. 18 is a reverse side of the in-fill piece particularly as shown in FIG. 10, FIG. 19 is a plan view of an assembly of eight round top tables connected together in accord with an eighth embodiment of the invention, FIGS. 20 and 21 are an underneath view and an upper plan view respectively of an in-fill piece used specifically in the eighth embodiment as shown in FIG. 19 to provide for an abutting engagement with respect to an assembly of the four round top tables with their respective in-fill pieces and FIG. 22 is a cross-sectional view along the lines 22—22 as shown in FIG. 19.

Referring to the drawings in detail and in particular to the first embodiment, there are shown two round top tables 1 and 2 each of which are of an identical size and shape and each of which are supported in a common manner by a single central support leg 3 and 4 each support leg being stabilized by outwardly extending feet shown respectively at 5 in one case and 6 in the other.

The round table tops 1 and 2 however are located in an almost closely abutting location and have in-fill pieces 7 and 8 each of which is in accord with the details shown in FIG. 4 and in FIG. 6.

The purpose of the in-fill pieces 7 and 8 is to provide a continuously flush uppermost surface between the uppermost surfaces of the round tops 1 and 2 and to provide in a tangentially extending alignment an outer edge shown respectively at 9 and 10 against which persons who which to use the combination of tables may appropriately be located and moreover adequately be supported by any of the respective parts of the in-fill pieces 7 and 8.

Two problems with this arrangement extend firstly to the external appearance of such as assembly which is predominantly related to the shape of the outer rim shown at 10 in respect of table 2 and the second problem relates to the functionality of such a peripheral edge either by way of vulnerability to damage or conversely to its ability to entrap food particles and not be easily cleaned.

To this end then there is provided as particularly is shown in FIG. 3, a peripheral shape which includes as an externally exposed surface a convex shape 11 when locked at in cross-section and which shape 11 is outwardly facing from the body 12 of the circular top table 2.

There is a matching complimentary shape shown at 13 which is provided by the respective edges of the in-fill piece 10 and there are clamp means 14 adapted to engage with an outwardly and upwardly extending clamp arm 14 which is adapted to be raised into a tightening and clamping position by a clamping assembly 15.

The clamping assembly 15 includes an engaging screw head 16 which engages a bolt 17 which thereby can press through spring pressure 18 the clamp arm 14.

The clamp arm 14 includes a web 19 which is the part actually engaging against the underneath edge 20 of the edge part 21.

The convex shape 11 extends from an upper and inner corner location which provides both horizontal location for the in-fill member and by reason of the leg 23, vertical support for this, and then in a complimentary manner horizontal location by vertical part 24 and vertical support by reason of contact of the outwardly extending edge 25 of the convex part 11.

Such a shape is matched to some extent by an outer edge 26 of the clamping assembly 15 in which there is an outer most convex shape 27 having at a lowermost end an outwardly extending abutment part 28.

To finish the description, the round table top has a substantial part of the top made from molded plastics material at 29, an uppermost insert 30 and an underneath metal reinforcement member 31 which is secured at various locations around an underneath peripheral portion by screws 32 mutually engaging through the respective parts 29 and 30.

With each in-fill piece of generally triangular shape shown for instance as at 7 and 8, these define a part circular edge as shown at 33 and 34 in FIG. 4 and at the apex 35 this is caused to interconnect between an upper and lower part of the respective edges of the table tops typically at 1 and 2 by which their respective parts of the table top can be held in a joining relationship.

Throughout the remainder of the description, it will be seen that the various elements both of the round table tops, the edges and the in-fill pieces retain common features and these will generally now be referred to with common numbering with the already described features.

The description therefore will refer in the main to the differences which are apparent in respect of the respective embodiments.

Accordingly as shown in FIG. 5, while the outwardly extending arms 14 provide a similar clamping arrangement, the outwardly extending corner shown at 36 is fully extended as shown in FIG. 4 but the opposite end shown at 37 is shortened and cut at an angle so as to allow for the relative rotation of the respective table tops gripped thereby particularly as shown in the second embodiment with respect to in-fill pieces 38 and 39, in-fill piece 38 corresponding most specifically to the in-fill piece shown from an underneath view in FIG. 5.

The apex 35 is formed by a frustro triangular piece 40 which is bolted through bolts 41 to provide the arrangement as shown in FIG. 8 in cross-section.

Various arrangements by which the respective tables can be assembled is shown apart from in FIG. 1 in the various FIGS. 9, 10, 11, 12, 13, 14 and 19.

In each of these cases, there is used at least one conventionally shaped in-fill piece as is shown in FIG. 1 and the respective drawings showing this first embodiment but the additional shapes are achieved by using additional in-fill pieces and in particular apart from the slightly augmented edges as shown in FIG. 9 at 38 and 39, a star shape in-fill piece at 32 which has three clamping members to clamp respectively at 43, 44 and 45, a star shaped in-fill piece 46 as shown in FIG. 11 which has four clamping members which will clamp respectively at the edges 47, 48, 49 and 50.

FIG. 12 showing the fifth embodiment is simply an assembly using already described in-fill pieces such as 38, 39 and 7 and the next variation comes from FIG. 19 in which there are corner pieces 51, 52, 53 and 54.

The purpose of these corner pieces is to provide an abutting edge against a linear alignment of an already in-filled assembly.

The shape of such a corner piece is particularly shown in FIGS. 20 and 21 including a clamping member 55 which is in substantially all respects the same as the previous clamping members and this is tightenable by screw head 56.

The way in which the clamp arms engage the linear alignment of a conventional corner piece at 7 is shown particularly in FIG. 22 in which the clamp arm 55 has an extension piece 57 which is attached through a screw and bolt 58 to the standard shape of the clamp arm 55 and this has at an outer end an upturned part 59 interlockably engaging with a lowermost edge 60 of the triangular piece 7 and an upstanding part 61 provides horizontal alignment with the outer face 62 of the edge of the triangular piece 7.

There is otherwise an outwardly extending ledge 63 with engages with abutting location so as to align with the convex shape 64 of the in-fill piece 7 and there is a downwardly extending leg 65 providing both horizontal and vertical interlocking engagement with respect to the outer edge of the in-fill piece 7.

In order to finish the description then, the tables variously located in FIGS. 9, 10, 11, 12, 13, 14 and 19 are all identical and of the same shape and height accordingly and for identification purposes only are all referred to by the numeral 70.

Each of the conventional triangular shaped in-fill pieces is referred to as 7 and to this extent FIG. 13 is interesting in that there is a gap of triangular shape left in the middle shown at 72.

Further, an in-fill piece with one augmented side as is shown in FIG. 9 as 38 and 39 are respectively then described with these same numerals in the remainder of the Figures and the in-fill pieces with both outer corners augmented is shown at 71.

From this description now it will be realised how simple it is to in fact build up in any manner of different combinations, combinations of round top tables of the same shape and height and while the same size has been described throughout, it is fully realised that in special circumstances, in-fill pieces can be made which can in-fill between round top tables of different diametral size.

Turning now to the in-fill parts, while there has been description relevant to the clamping of the specifically characterized in-fill parts, one further aspect of advantage is to provide that the in-fill part, for instance the triangular part, has at its apex, guide pieces which when inserted into an appropriate space between adjoining table top will capture the underneath lip and draw and subsequently hold the respective table tops together simply by reason of the insertion action of the in-fill piece. The in-fill piece is then held by the several clamps one to each side and in respect to each of several of the adjoining tables but the inner end has this interlocking engaging shape which assists passively to hold the member at this inner location.

While reference has been made generally to the characteristics of the in-fill piece and to the tables and to table tops, without discussing the material of manufacture, it is acknowledged that such table tops can be made from a variety of materials including wood or can be fabricated from plastics including fibre reinforced plastics materials or injection moulded plastics.

One of the advantages of providing a lip and having this substantially smooth outer convex surface is that al of these techniques become available and appropriate.

According to a further constructional technique then there is provided for the table top, a member comprised oppositely of a top comprised of a plastics material and an underneath reinforcing element.

This underneath reinforcing element can be a pressed metal element which is anchored to respective plate places beneath the plastic table top.

Another feature of such a table top can be that an inner part can be inset so as to provide for inclusion thereon of any appropriate surfacing material other than the plastic material from which the table top might be constructed.

Once again the shape with the in-fill pieces which can also incorporate the inset part is very appropriate for commercial applications.

I claim:

1. A round top table arrangement comprising at least two round top tables in adjacent relationship and at least two in-fill pieces, each of the said in-fill pieces extending between respective adjacent edges of the adjacent tables and having an approximately triangular shape, the sides of the triangular shape having a concave shape aligning to match with that of the appropriate edge of the round top of the respective table.

2. A round top table arrangement as in claim 1 further characterised in that the said round top tables are each of the same diameter and height.

3. A round top table arrangement as in the claim 2 in which the in-fill pieces each of triangular shape are located in an apex to apex alignment and having an outermost edge in each case of linear alignment which is aligned substantially tangentially to the circular peripheral shape of the respective round top of a respective table.

4. A round top table arrangement as in claim 2 in which an outer peripheral edge of each of the respective round tops of the tables includes an outermost convex shape.

5. A round top table arrangement as in claim 4 further characterised in that each in-fill piece engages with matching shape a respective convex shape of the outer periphery of the round top.

6. A round top table arrangement as in claim 1 or 2 in which there is, around the edge of each of the round top tables, as an externally exposed surface, a convex shape when locked at in cross-section and which shape is outwardly facing from the body of the round top table, and a matching complimentary shape along the respective engages edges of at least one of the in-fill pieces, and clamp means adapted to engage beneath a portion of the round top table whereby to enable a holding together of the respective parts.

7. A round top table arrangement as in claim 6 in which each round table top also includes a lip extending downwardly about its periphery, and each of said in-fill pieces includes a clamping means having a clamp arm arranged for tightening engagement against an inner part of said lip.

8. A round top table arrangement as in claim 6 in which the convex shape of the exposed surface extends from an upper edge of the round top of the table to be tangential and coincident with a flat upper surface just below an uppermost surface of the table top, and then proceed to extend around to be substantially vertical when the table is on a horizontal base, and toward a lowermost end, a first substantially vertical step, a then substantially horizontal portion curving around to a substantially vertical portion and then an outwardly extending step terminating in the outer edge of the bottom of the lip part.

9. A round top table arrangement as in claim 8 in which a corresponding edge shape of said in-fill piece has an outer surface corresponding to the shape of the convex shape but having dimensions such that an upper edge of the outer surface is located in coincident alignment to provide a flush upper surface with the top of the round table top.

10. A round top table arrangement as in claim 8 in which there is a clamping means including clamping arm having an outwardly and upwardly extending part which is adapted upon tightening of an engaging screw head to engage with clamping effect a portion of the outer edge of a respective part of the round top of the table.

* * * * *